United States Patent [19]

Peditto et al.

[11] 4,100,085

[45] Jul. 11, 1978

[54] PROCESS FOR THE PREPARATION OF ADDITIVES FOR LUBRICATING OILS

[75] Inventors: Andrea Peditto, Turin; Franco Fossati, Robassomero (Turin); Vincenzo Petrillo, Cirie (Turin), all of Italy

[73] Assignee: Liquichimica Robassomero S.p.A., Milan, Italy

[21] Appl. No.: 750,696

[22] Filed: Dec. 15, 1976

[30] Foreign Application Priority Data

Dec. 24, 1975 [IT] Italy ..... 30779 A/75

[51] Int. Cl.[2] ..... C10M 1/54; C10M 3/48; C10M 5/28; C10M 7/52

[52] U.S. Cl. ..... 252/42.7

[58] Field of Search ..... 252/33, 42.7

[56] References Cited

U.S. PATENT DOCUMENTS

| | | | |
|---|---|---|---|
| 3,178,368 | 4/1965 | Hanneman | 252/33.4 |
| 3,827,979 | 8/1974 | Piotrowski et al. | 252/33 |
| 3,865,737 | 2/1975 | Kemp | 252/33 |

*Primary Examiner*—Delbert E. Gantz
*Assistant Examiner*—Irving Vaughn
*Attorney, Agent, or Firm*—Cushman, Darby & Cushman

[57] ABSTRACT

In a process for the preparation of detergent additives for lubricant oils, of the type in which an alkylphenol-sulfide is neutralized with an oxygen containing compound of an alkaline earth metal and carbonated with carbon dioxide, the process and particularly the neutralization step is carried out in the presence of a promotor selected from $NH_3$ and $NH_4OH$ and a co-promoter which is a short chain alcohol having not more than 5 carbon atoms.

6 Claims, No Drawings

PROCESS FOR THE PREPARATION OF ADDITIVES FOR LUBRICATING OILS

The present invention relates to detergent additives for lubricating oils, and more particularly a process for the preparation thereof.

Detergent additives for lubricating oils are already known, having phenolic base and endowed with particular properties as alkali reserve for the neutralization of the acidic substances which build up into the lubricant or pollute it during the use.

It is already known the use of detergent additives, based on sulfurized alkylphenols, neutralized by earth-alkali metals, mainly barium or calcium, containing, if any, in alkali reserve, in form of carbonate or hydroxide, especially in the lubricants for Diesel engines: the starting compound for preparing these additives is an alkylphenol, usually having $C_8$–$C_{12}$ side chains, which is variously sulfurized with elemental sulfur or derivatives thereof, either before or after the neutralization with an earth-alkali metal, the sulfurized alkylphenol being sometimes subsequently carbonated with $CO_2$, either alone or in admixture with other gases, in the presence of an excess of the oxide or hydroxide of the metal and of one or more promoters.

The main purpose of the present invention is to provide a detergent additive of the above defined type through an improved process.

Such a purpose is achieved through a process of the type in which an alkylphenolsulfide, having the formula

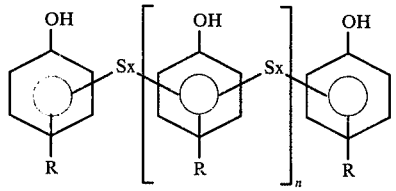

wherein R is a $C_8$–$C_{20}$ alkyl radical, $x$ has an average value of between 1 and 2, preferably of between 1 and 1.5, and $n$ is an integer of between 0 and 3, is reacted with an oxygen bearing compound of an earth-alkali metal and carbonated with carbon dioxide, characterized in that the reaction between the alkylphenolsulfide, the oxygen bearing compound of the earth-alkali metal and the carbon dioxide, is carried out in the presence of a promoter consisting of either anhydrous $NH_3$ or $NH_4OH$, and of a copromoter selected amongst the alcohols having a short chain, anyhow not higher than $C_5$, the lower homologues being preferred.

According to the preferred embodiment of the above defined process, the addition of the promoter takes place at or immediately before the neutralization step, whereas the addition of the co-promoter takes place at or immediately before the carbonating step, the two steps being thus distinct, the first step occurring at a temperature of between 70° C and 130° C and the second step taking place at a temperature of between 55° C and 130° C, depending on the boiling point of the co-promoter, the neutralization step being completed in a preferred time of between 30 and 180 minutes and the carbonating step being completed preferably in a time of between 90 and 360 minutes.

As the oxygen bearing compound of an earth-alkali metal, the use is preferred of calcium oxide or hydroxide, small amounts of water being possibly added in the case in which calcium oxide is used.

The experimental tests have demonstrated that by the above defined process exceedingly fine dispersions of $CaCO_3$ and $Ca(OH)_2$ are obtained and basic species are formed which are not univocally identified, and probably correspond to mixed suspensions of carbonates, hydrated oxides and basic phenates: it seems likely to assume that the function of the promoter is that of encouraging the forming of all these species, by acting as an activator of the phenolic substrate, still in the neutralization step, whereas the co-promoter would have the function of accelerating such a formation, by facilitating the carbonating step through solvating mechanisms of the earth-alkaline reactant and of the product-promoter complex.

Through the use of the promoter and of the co-promoter according to the present invention there is achieved, in respect of the compounds already known in this field (mainly higher alcohols and polyols), not only a relevant simplification of the process operation, but also a remarkable advantage as regards the recovery of the reaction product: in fact, both $NH_3$ and $NH_4OH$ are highly volatile compounds and, consequently, very readily removable from the reaction mixture even at relatively low temperatures, whereby there are omitted costly and complicated processes for the evaporation under high vacuum, as well as high temperature treatments, by which degradation of the product, especially at the level of the sulfur bonds, can be induced.

More particularly the ammonia, in comparison with other nitrogen containing compounds, shows both the advantage of an highly easy removal, and of the low cost, which can be more evident if attention is made to the recycling of the promoter which can be perfectly effected after the removal from the reaction mixture.

The following example illustrate, without limiting purposes, the invention.

EXAMPLE

A reaction vessel was charged with 315 g. of n-nonane, 155 g. of a sulfurized alkylphenol having the above formula (R being a propylene oligomer, $x$ being on the average 1.25 and $n$ being 1), and 5 g. of a 32% solution of $NH_4OH$. The mixture, under stirring, was brought to 80° ± 2° C and then added with 112 g. of $Ca(OH)_2$; thereafter, by maintaining the stirring action and the temperature of 80° ± 2° C, the neutralization was carried out for 60 minutes. Then, the temperature was raised to 125° ± 2° C, the water and ammonia excess being removed. The mixture was thereafter cooled to 64° ± 2° C and 168 g. of methanol were added: the mixture was then carbonated, under stirring, at 64° ± 2° C by 49 g. of $CO_2$. At the end of the carbonating step, the temperature was slowly raised to 125° C, the methanol being removed and 196 g. of a lubricating oil, having viscosity of 150 SSU at 100° F (37.8° C), being added. The product was then filtered and evaporated for the removal of the reaction solvent. A product was obtained containing 9.54% Ca and 3.23% sulfur, the viscosity being 152 centistokes at 210° F (about 97° C).

What we claim is:

1. In a process for preparing a detergent additive for a lubricating oil, of the type in which an alkylphenolsulfide, having the formula:

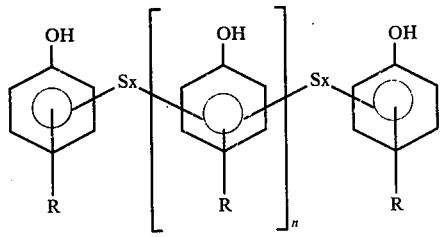

wherein R is a $C_8$–$C_{20}$ alkyl group, $x$ had a value of between 1 and 2 and $n$ is an integer of between 0 and 3, is reacted with calcium oxide or calcium hydroxide and carbonated with carbon dioxide, the improvement comprising carrying out the reaction in the presence of (1) a promoter selected from the group consisting of $NH_3$ and $NH_4OH$, and (2) a co-promoter which is a short chain alcohol having not more than 5 carbon atoms.

2. A process according to claim 1 wherein the promoter is added to the reaction mixture at or immediately before the neutralization reaction of the alkylphenolsulfide with the calcium oxide or calcium hydroxide, the reaction taking place at a temperature of between 7020 and 130° C and for a time of between 30 and 180 minutes.

3. A process according to claim 2 wherein the co-promoter is methanol.

4. A process according to claim 1 wherein the co-promoter is methanol.

5. A process according to claim 2 wherein the materials employed in the process consist essentially of (1) said alkylphenol sulfide, (2) calcium oxide or calcium hydroxide, (3) ammonia or ammonium hydroxide, (4) said co-promoter, (5) water and (6) carbon dioxide.

6. A process according to claim 1 wherein the materials employed in the process consist essentially of (1) said alkylphenol sulfide, (2) calcium oxide or calcium hydroxide, (3) ammonia or ammonium hydroxide, (4) said co-promoter, (5) water and (6) carbon dioxide.

* * * * *